United States Patent [19]

Thorneburg

[11] 4,104,892

[45] Aug. 8, 1978

[54] CUSHIONED SOLE TUBE SOCK AND METHOD

[75] Inventor: James L. Thorneburg, Statesville, N.C.

[73] Assignee: Thorneburg Hosiery Mill, Inc., Statesville, N.C.

[21] Appl. No.: 741,885

[22] Filed: Nov. 15, 1976

[51] Int. Cl.[2] ..... A41B 11/02

[52] U.S. Cl. ..... 66/185; 2/239; 66/186; 66/194; 66/136; 66/178 R

[58] Field of Search ..... 66/194, 178, 185, 187, 66/180, 49, 136, 135; 2/239

[56] References Cited

U.S. PATENT DOCUMENTS

| | | | |
|---|---|---|---|
| 669,530 | 3/1901 | Kilborn | 66/179 |
| 759,184 | 5/1904 | Meyer | 66/178 |
| 810,095 | 1/1906 | Thus | 66/178 |
| 1,023,313 | 4/1912 | Hirner | 66/187 |
| 1,252,983 | 1/1918 | Ames | 66/179 |
| 1,413,337 | 4/1922 | Landry | 66/179 |
| 2,144,563 | 1/1939 | Davis | 66/185 X |
| 2,546,444 | 3/1951 | Hall | 66/187 X |
| 2,569,434 | 9/1951 | Ischinger | 66/178 X |
| 3,324,686 | 6/1967 | Rosenstien | 66/187 |
| 3,793,851 | 2/1974 | Thorneburg | 66/194 |
| 3,796,067 | 3/1974 | East | 66/194 |
| 3,828,585 | 8/1974 | Thorneburg | 66/136 |

*Primary Examiner*—Ronald Feldbaum

*Attorney, Agent, or Firm*—Bell, Seltzer, Park & Gibson

[57] ABSTRACT

This tube sock includes a cushioned sole formed by partial courses of terry loops on the inner surface of at least that part of the foot portion adapted to underlie the sole of a wearer's foot while that part of the foot portion adapted to overlie the instep of the wearer's foot is devoid of terry loops. Indicia means is provided on the outer surface of the foot portion for indicating the proper manner in which the tube sock should be worn to position the terry loops beneath the sole of the wearer's foot. The indicia means may take the form of an identifying yarn contrasting in color with the color of the body yarn of the sock and knit in plated relationship with the body yarn to appear on the outer surface of the sock in spaced-apart coursewise extending stripes which extend from one side to the other of the sole portion.

6 Claims, 6 Drawing Figures

CUSHIONED SOLE TUBE SOCK AND METHOD

This invention relates generally to a cushioned sole tube sock and more particularly to such a sock with suitable indicia on the outer surface of the sock for indicating the proper manner in which the tube sock should be worn to position the terry loops beneath the sole of a wearer's foot.

It has been known for many years to provide a "cushioned sole" in socks by forming partial courses of terry loops on the inner surface of that part of the foot adapted to underlie the sole of the wearer's foot. In this prior type of sock, a heel pocket is provided by reciprocatorily knitting partial courses while first narrowing and then widening to form the heel pocket. Since this type of sock has a definite pocket for accommodating the heel of the wearer, the terry loops on the inner surface of the sock are properly positioned to underlie the sole of the wearer's foot when the heel pocket is properly positioned on the wearer's foot.

In recent years, the so-called "tube" type sock has become very popular. The heel pocket has been eliminated in this tube type sock so that the sock will fit various foot sizes and the heel of the wearer may be positioned in any position circumferentially of the tube sock. When it is desired to incorporate a "cushioned sole" in this type of tube sock, it has been the common practice to form terry loops around the entire inner surface of the foot portion of the sock to insure that the terry loops always underlie the sole of the wearer's foot, regardless of the rotational position of the sock when it is placed on the foot. While the formation of terry loops around the entire inner surface of the foot insures that terry loops are always positioned beneath the sole of the wearer's foot, the terry loops also overlie the instep of the wearer's foot thereby increasing the overall bulk and thickness of the sock.

With the foregoing in mind, it is an object of the present invention to provide a cushioned sole tube sock wherein the foot portion includes partial courses of terry loops on the inner surface of at least that part of the foot portion adapted to underlie the sole of a wearer's foot while that part of the foot portion adapted to overlie the instep of a wearer's foot is devoid of terry loops and to provide identifying indicia means on the outer surface of the foot portion for indicating the proper manner in which the tube sock should be worn to correctly position the terry loops beneath the sole of a wearer's foot.

In accordance with the present invention, the partial courses of terry loops may also be included in the heel portion of the tube sock and the indicia means provides a contrasting appearance between at least a certain portion of the foot portion and the remainder thereof. The indicia means may comprise an identifying yarn knit in plated relationship with the body yarn to appear on the outer surface of the sock and with the color of the identifying yarn contrasting with the color of the body yarn of which the remaining portions of the sock are knit. The identifying yarn may be knit in spaced-apart coursewise extending stripes with the stripes extending from one side to the other of the sole portion.

The tube sock of the present invention may be easily knit on a conventional hosiery knitting machine by knitting the body yarn into a plurality of successive complete circular courses to form the leg and foot portions of the sock. Partial courses of terry loops are formed on at least the inner surface of the sole portion while the instep portion is devoid of terry loops. Indicia means is provided on the outer surface of the foot portion to indicate to the wearer the proper manner in which the tube sock should be positioned on the foot to correctly position the terry loops beneath the wearer's foot. The indicia means may include plated yarn stripes formed by knitting an identifying yarn in spaced-apart coursewise stripes extending from one side to the other of the sole portion of the sock.

Other objects and advantages will appear as the description proceeds when taken in connection with the accompanying drawings, in which FIGS. 1 and 2 illustrate opposite side views of the tube sock of the present invention showing the correct positioning of the sock on the foot of a wearer so that the terry loops are positioned beneath the sole of the wearer's foot;

Figure 3:
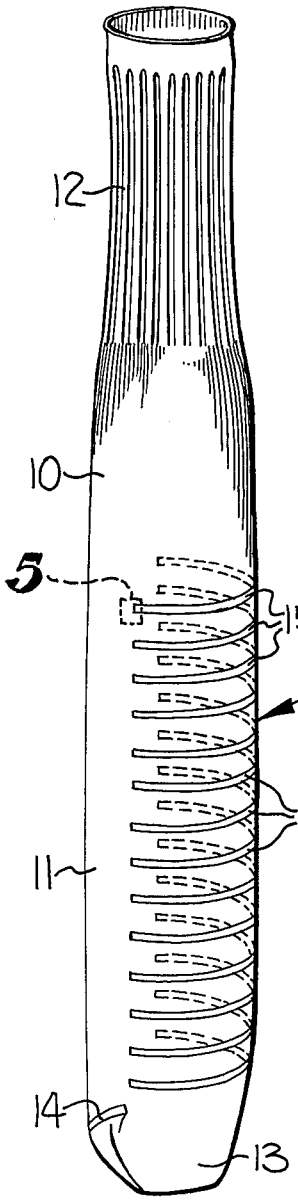
FIG. 3 is a perspective view of the present sock in right-side-out condition and illustrating the indicia means in the form of spaced-apart stripes on the outer surface of the foot portion for indicating the proper manner in which the tube sock should be worn to position the terry loops beneath the sole of a wearer's foot.
Figure 4:
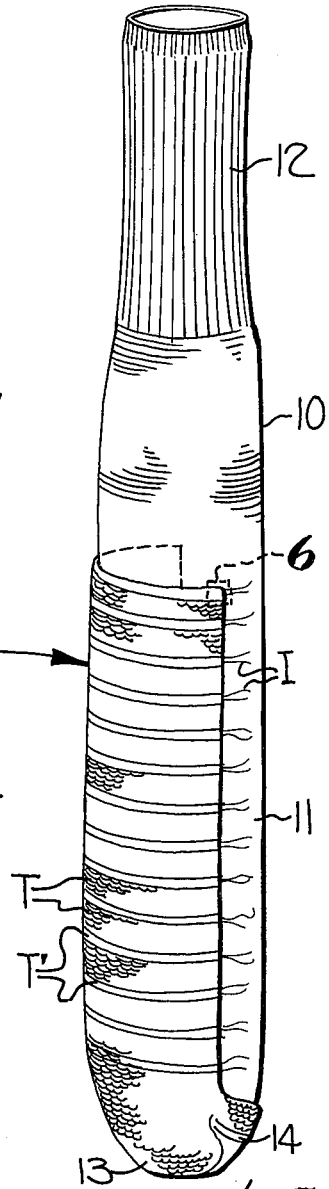
FIG. 4 is a view similar to FIG. 3 but illustrating the sock in wrong-side-out condition and illustrating the partial courses of terry loops on the inner surface of that part of the foot portion adapted to underlie the sole of the wearer's foot.
Figure 5:
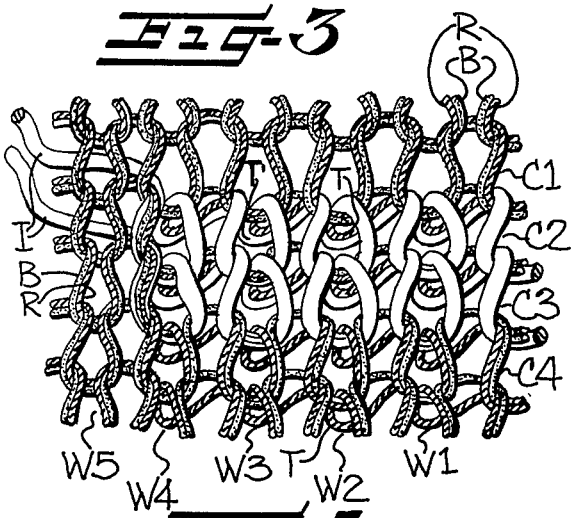
Figure 6:
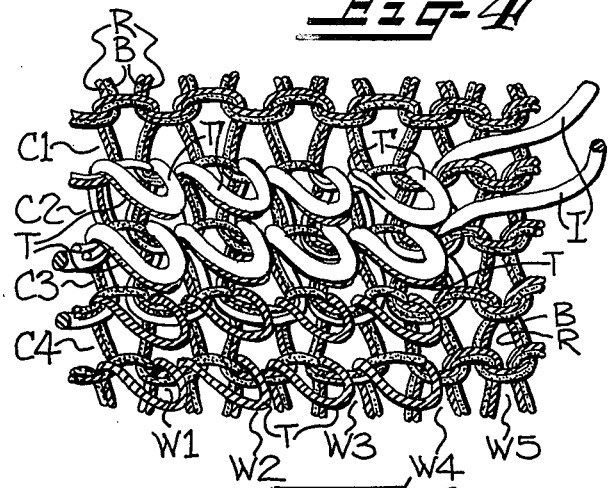

FIG. 5 is a greatly enlarged fragmentary view of the small area of the sock enclosed by the dotted square 5 in FIG. 3 and illustrating the manner in which the identifying yarn is knit in plated relationship with the body yarn to form the identifying stripes in the sock; and FIG. 6 is a view similar to FIG. 5 but being taken in the dotted square 6 in FIG. 4 and illustrating the manner in which the identifying yarn also forms terry loops on the inner surface of the sock.

Figure 1:
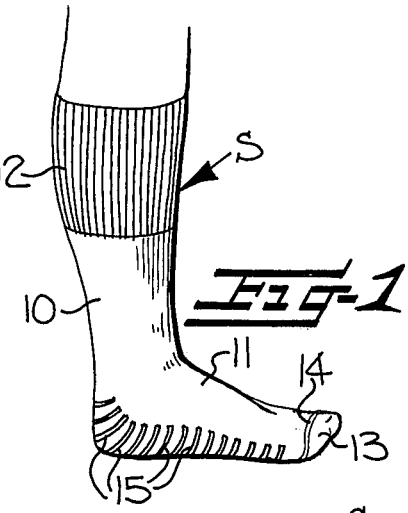
Figure 2:
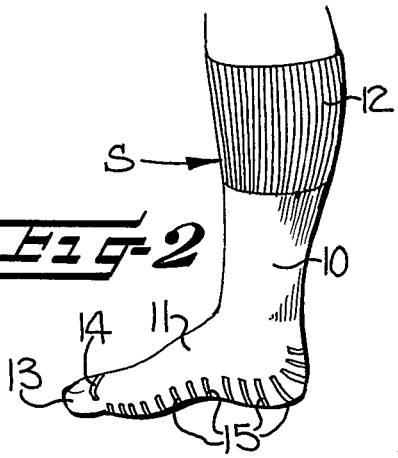

The cushioned sole tube sock of the present invention includes a leg portion 10 and a foot portion 11 which are knit throughout of complete circular courses of body yarn, indicated at B in FIGS. 5 and 6, and with the body yarn B being speckled for ease of identification. The upper portion of the leg 10 may include a mock rib cuff portion 12 in which an elastic yarn is incorporated in any conventional manner, such as by inlaying in a 2 × 2 manner. The lower end of a foot portion 11 is provided with a toe 13 which may be formed in the usual manner with narrowing and widening of partial courses and closed by a seam 14 which may extend above or beneath the toes of the wearer. Also, the toe may be formed by seaming the lower end of the foot closed with a curved seam extending around the ends of the toes of the wearer in what is commonly referred to as a "fish mouth" toe closure. Since the leg 10 and foot 11 are formed of complete circular courses, the usual fashioned heel pocket is not provided in the tube sock of the present invention and the fabric in the foot portion 11 is stretched over and conforms to the heel of the wearer, as illustrated in FIGS. 1 and 2.

In accordance with the present invention, the foot portion 11 includes partial courses of terry loops on the inner surface of at least that part of the foot portion adapted to underlie the sole of the wearer's foot while that part of the foot portion adapted to overlie the instep of the wearer's foot is devoid of terry loops. As illustrated in FIG. 4, the partial courses of terry loops extend substantially one-half the distance around the inner surface of the sock. The terry loops extend upwardly a sufficient distance in the foot portion 11 to underlie the heel and extend downwardly a sufficient distance to underlie the toes and may, as illustrated, extend throughout the entire toe area.

Since the location of the partial courses of terry loops on the inner surface of the sock is not identifiable when the sock is turned to the right-side-out condition illustrated in FIG. 3, indicia means is provided for indicating the manner in which the tube sock should be properly worn. In the present instance the indicia means is provided on the outer surface of the foot portion of the sock. It is to be understood that various types of indicia means can be provided on the outer surface of the sock for indicating the manner in which the tube sock should be properly worn, even though only one particular type of indicia means is illustrated in the drawing.

As shown in the drawings, the indicia means comprises an identifying yarn I (FIGS. 5 and 6) knit in plated relationship with the body yarn B to appear on the outer surface of the sock in spaced-apart coursewise extending stripes 15 with the stripes extending from one side to the other of the sole portion of the sock. While the stripes 15 may be varied as desired, it has been found that an attractive pattern is provided when the identifying yarn I is of a color which contrasts with the color of the body yarn and when the partial courses of the identifying yarn I include two adjacent partial courses with ten courses of body yarn between each of the stripes 15.

It is preferred that the complete courses of the leg 10 and foot 11 be knit with a reinforcing yarn R, striped in FIGS. 5 and 6 for ease of identification. The yarn R is knit in plated relationship with the body yarn B and forms the partial courses of terry loops, indicated at T in FIGS. 4 and 6, on the inner surface of that part of the foot portion adapted to underlie the sole of the wearer's foot. The terry loops T are formed in a well-known manner by inserting the sinkers between the needles so that the yarn R is laid over the nibs of the sinkers while the body yarn B is fed in the throats of the sinkers and beneath the nibs. Of course, the yarn R does not form terry loops on the instep portion of the foot so that that part of the foot portion adapted to overlie the instep of the wearer's foot is devoid of terry loops because the yarn R is knit in plain plated relationship with the body yarn B in the instep area, as illustrated in wales W-4 and W-5 in FIGS. 5 and 6. Also, no terry loops are formed in the leg portion 10 since the body yarn B and the reinforcing yarn R are knit in plain plated relationship, in the manner illustrated in course C-1. As illustrated in courses C-2 and C-3, all three of the yarns are knit in plated relationship while the yarns I and R form respective terry loops T' and T and the yarn I is plated to form the stripes 15 appearing on the outer surface of the sock, as illustrated in FIGS. 3 and 5. As illustrated in FIGS. 5 and 6, free ends of the identifying yarn I are provided as this yarn is introduced and removed in the conventional name at the beginning and end of each partial course so that relatively short free yarn ends of the identifying yarn extend from each edge of the partial courses of terry loops.

Thus, the spaced-apart stripes 15 provide indicia means for indicating the manner in which the tube sock should be correctly positioned on the foot so that the partial courses of terry loops on the inner surface of the sock will underlie the sole of the wearer's foot. Thus, when the stripes 15 extend beneath the foot, as illustrated in FIGS. 1 and 2, the wearer will know that the partial courses of terry loops are correctly positioned beneath the foot. The cushioned sole tube sock of the present invention thus indicates to the wearer when the sock is positioned in proper position on the foot with the terry loops underlying the sole of the foot and it is not necessary to form terry loops around the entire inner surface of the sock, as has been the prior practice. The terry loops are therefore provided only in the part of the sock where they are needed, beneath the foot of the wearer, and are not present in those areas where they are not desired, across the instep of the wearer's foot.

In the drawings and specification there has been set forth a preferred embodiment of the invention, and although specific terms are employed, they are used in a generic and descriptive sense only and not for purposes of limitation, the scope of the invention being defined in the claims.

That which is claimed is:

1. A knitted heelless stretchable tube sock, said sock being characterized, due to the lack of a heel pocket, by a tendency to gather and form wrinkles in the upper instep area due to the presence of surplus fabric in such area when the sock is worn in stretched condition, said sock comprising (a) a leg portion knit of a plurality of consecutive complete courses and having substantially the same fabric thickness throughout its length and periphery, (b) a heel portion knit integral with said leg portion and having a plurality of consecutive complete courses, said heel portion being circumferentially divided into first and second fabric areas of differential fabric thickness, said first fabric area including terry loops on the inner surface and defining a heavy fabric area, said second fabric area being devoid of terry loops and defining a relatively thinner fabric area, (c) a foot portion knit integral with said heel portion and having a plurality of consecutive complete courses, said foot portion being similarly circumferentially divided into first and second fabric areas of differential fabric thickness, said first fabric area including terry loops on the inner surface and defining a heavy fabric area, said second fabric area being devoid of terry loops and defining a relatively thinner fabric area, said first and second fabric areas of said foot portion being aligned with corresponding first and second fabric areas of said heel portion, (d) a closed toe portion formed integral with said foot portion, and (e) means on the outer surface of said foot portion for identifying the relative positions of said first heavy fabric areas and said second relatively thinner fabric areas of said heel and foot portions to guide the wearer in placing the sock on the foot so as to position said relatively thinner fabric areas on top of the wearer's foot and said heavy fabric areas beneath the heel and sole of the wearer's foot whereby the tendency of the surplus fabric to form wrinkles at the upper instep area of the wearer's foot is minimized by the placement of the relatively thinner fabric at that area while affording maximum comfort and protection to the heel and sole of the wearer's foot.

2. A knitted heelless tube sock according to claim 1 wherein said means (e) is positioned on said heel and foot portions for identifying substantially the entire coursewise extent of said relatively heavy fabric areas in said heel and foot portions.

3. A knitted heelless tube sock according to claim 2 wherein said means (e) is also positioned on said heel and foot portions for identifying substantially the entire walewise extent of said relatively heavy fabric areas in said heel and foot portions.

4. A knitted heelless tube sock according to claim 1 wherein said means (e) comprises an identifying yarn knit to appear on the outer surface of said sock, said identifying yarn contrasting in color with the color of the yarn of which the remaining portions of said sock are knit.

5. A knitted heelless tube sock according to claim 1 wherein said means (e) comprises an identifying yarn knit to appear on the outer surface of said sock, said identifying yarn contrasting in color with the color of the yarn of which the remaining portions of said sock are knit, said identifying yarn being knit in spaced-apart coursewise extending stripes, and said stripes extending from one side to the other of said relatively heavy fabric areas in said heel and foot portions.

6. A knitted heelless tube sock according to claim 4 wherein said identifying yarn also forms terry loops extending inwardly in said relatively heavy fabric areas in said heel and foot portions.

* * * * *